US006942447B2

(12) United States Patent
Ikeya

(10) Patent No.: US 6,942,447 B2
(45) Date of Patent: Sep. 13, 2005

(54) IMPELLER PUMPS

(75) Inventor: Masaki Ikeya, Aichi-ken (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 25 days.

(21) Appl. No.: 10/656,214

(22) Filed: Sep. 8, 2003

(65) Prior Publication Data

US 2004/0071543 A1 Apr. 15, 2004

(30) Foreign Application Priority Data

Sep. 10, 2002 (JP) ..... 2002-303611

(51) Int. Cl.[7] ..... F01D 5/00
(52) U.S. Cl. ..... 415/55.1; 415/55.2; 415/55.6
(58) Field of Search ..... 415/55.1, 55.2, 415/55.3, 55.4, 55.6; 417/366

(56) References Cited

U.S. PATENT DOCUMENTS 5,017,086 A * 5/1991 Hansen ..... 415/55.5
6,152,688 A * 11/2000 Staab et al. ..... 415/55.5
6,733,230 B2 * 5/2004 Miura et al. ..... 415/55.1

FOREIGN PATENT DOCUMENTS

JP 05-18388 1/1993

* cited by examiner

*Primary Examiner*—Edward K. Look
*Assistant Examiner*—Igor Kershteyn
(74) *Attorney, Agent, or Firm*—Dennison, Schultz, Dougherty & MacDonald

(57) ABSTRACT

An impeller pump (1) for a fluid includes a rotary impeller (5) and a pump housing (3, 4). The pump housing defines a first main flow channel (3*a*) and a second main flow channel (4*a*). A first inlet channel (3*b*) and a second inlet channel (4*b*) also are defined in the pump housing. The first inlet channel communicates with one end of the first main flow channel and the second inlet channel communicates with one end of the second main flow channel, so that the fluid is drawn into a first pump chamber (1*b*) and the second pump chamber (1*c*) via the first inlet channel and the second inlet channel, respectively.

20 Claims, 7 Drawing Sheets

IMPELLER PUMPS

This application claims priority to Japanese patent application serial number 2002-303611, the contents of which are incorporated herein by reference.

BACKGROUND OF THE INVENTION

1. Field of the Invention

The present invention relates to impeller pumps of a type known as Westco pumps, generative or friction pumps, cascade pumps and circumferential-flow pumps that have rotary impellers.

2. Description of the Related Art

A known generative or friction pump 101 for pumping fuel is shown in FIGS. 10(A) and 10(B) and includes an impeller 102. The impeller 102 is disposed within a pump casing 106 and is rotatably driven by a motor 105 via a drive shaft 105*a* of the motor 105. Grooves 102*a* are defined in each of upper and lower surfaces of the impeller 102 and are arranged in the circumferential direction of the impeller 102. In order to minimize the outer diameter of the pump 101, a suction port 101*a* is defined in the pump casing 106, such that the fuel flows from the lower side of the impeller 102 into a first main flow channel 103*a* defined in the pump casing 106 in a direction perpendicular to the surface of the impeller 102. A second main flow channel 103*b* is defined in the pump casing 106 on the side opposite to the first main flow channel 103*a*. A plurality of communication holes 102*b* are defined in the impeller 102 and each of the communication holes 102*b* communicates between two of the grooves 102*a* that oppose to each other in the axial direction of the impeller 102 and defined in the upper and lower surfaces of the impeller 102, respectively. As a result, the fuel may flow uniformly into the first and second main flow channels 103*a* and 103*b* disposed on both sides of the impeller 102, so that the pumping efficiency may be improved. This type of known generative or friction fuel pump is disclosed in Japanese Laid-Open Patent Publication No. 5-18388.

However, when the grooves 102*a* with the communication holes 102*b* are positioned to communicate with the suction hole 101*a* during the rotation of the impeller 102, the grooves 102*a* cannot produce circulation (swirl) of flow of the fuel. Therefore, it is not possible to start the pumping action immediately after the fuel has been drawn into the suction hole 101*a*. Due to this phenomenon, there still exiests a problem that the pumping efficiency is degraded. In order to improve the pumping operation, the rotational speed of the impeller 102 may be increased. However, this may increase the amount of consumption of the electric power.

SUMMARY OF THE INVENTION

It is accordingly an object of the present invention to teach impeller pumps that can improve the pumping efficiency.

According to one aspect of the present teachings, impeller pumps for fluids are taught that include a rotary impeller and a first and second pump chambers defined on both sides of the impeller. A first inlet channel and a second inlet channel are defined in the pump housing. The first inlet channel communicates with one end of the first main flow channel and the second inlet channel communicates with one end of the second main flow channel, so that the fluid is drawn into the first pump chamber and the second pump chamber via the first inlet channel and the second inlet channel, respectively.

Therefore, it is not necessary to provide communication holes in the impeller in order to communicate between the first pump chamber and the second pump chamber. The fluid may be pumped by the pumping actions of the impeller when the fluid reaches the start end of the first and second pump chambers via the first and second inlet channels, respectively. As a result, the pumping efficiency may be improved.

According to another aspect of the present teachings, at least one of the first and second inlet channels is configured to improve the pumping efficiency by controlling the flow of the fluid. For example, the at least one of the first and second inlet channels may be configured not to directly open into the space defined in the pump housing for rotatably receiving the impeller. Alternatively, the direction(s) of the at least one of the first and second inlet channels may be determined to provide a smooth flow of the fluid, to intensify the swirls that may be produced when the fluid flows into the corresponding pump chamber(s), or to provide a long flow path(s) along the corresponding main flow channel(s).

According to another aspect of the present teachings, at least one of the first and second outlet channels also may be configured to improve the pumping efficiency by controlling the flow of the fluid. For example, the direction(s) of the at least one of the first and second outlet channels may be determined to provide a long flow path(s) along the corresponding main flow channel(s).

According to another aspect of the present teachings, the flow of the fluid from the first outlet channel and the flow of the fluid from the second outlet channel converge at a convergence port defined in the pump housing.

According to another aspect of the present teachings, the pump housing comprises a first pump housing member and a second pump housing member. The first inlet channel, the first main flow channel and the first outlet channel are defined in series in the first pump housing member, and the second inlet channel, the second main flow channel and the second outlet channel are defined in series in the second pump housing.

According to another aspect of the present teachings, the impeller pump further includes a motor for rotating the impeller.

BRIEF DESCRIPTION OF THE DRAWINGS

Additional objects, features and advantages of the present invention will be readily understood after reading the following detailed description together with the claims and the accompanying drawings, in which:

FIG. 5(*b*) is a schematic front view showing a modification of the fourth representative impeller pump;

FIG. 6(*b*) is an enlarged vertical sectional view similar to FIG. 6(*a*) but showing a part of a pump housing of a modification of the fifth representative impeller pump;

FIG. 7(*b*) is a side view of the pump housing of the sixth representative impeller pump;

FIG. 10(*b*) is a cross sectional view taken along line X—X in FIG. 10.

DETAILED DESCRIPTION OF THE INVENTION

Figure 1:
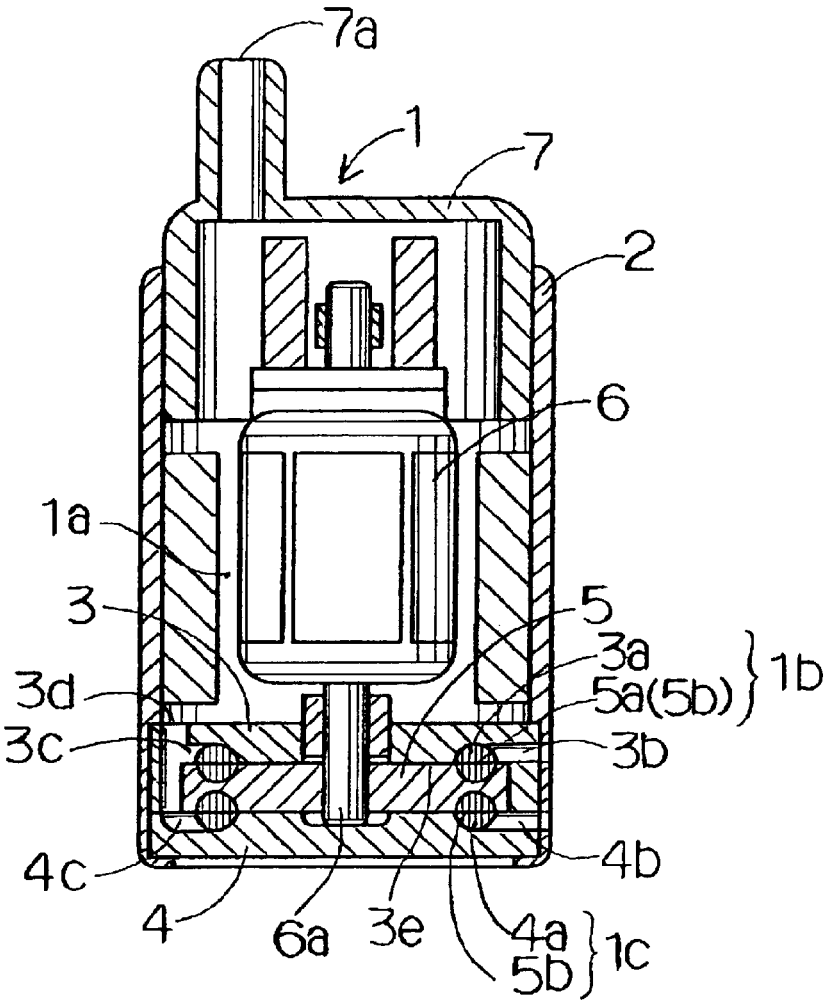
FIG. 1 is a vertical sectional view of a first representative impeller pump according to the present invention.

In one embodiment of the present teachings, impeller pumps for fluids may include a rotary impeller and a pump housing. For example, the fluids may be fuels and the impeller pumps may be fuel pumps for supplying the fuels to internal combustion engines of automobiles. The pump housing defines a first main flow channel and a second main flow channel. The rotary impeller is disposed within a space defined in the pump housing and opposes to the first main flow channel and the second main flow channel, so that a first pump chamber and a second pump chamber are defined on both sides of the impeller. The rotary impeller may have rows of grooves formed on both sides of the impeller and the grooves in each row are spaced equally from each other in the circumferential direction.

A first inlet channel and a second inlet channel are defined in the pump housing. For example, the first and second inlet channels may be separate bores formed in the pump housing. The first inlet channel communicates with one end of the first main flow channel and the second inlet channel communicates with one end of the second main flow channel, so that the fluid is drawn into the first pump chamber and the second pump chamber via the first inlet channel and the second inlet channel, respectively.

A first outlet channel and a second outlet channel are defined in the pump housing. The first outlet channel communicates with the other end of the first main flow channel and the second outlet channel communicates with the other end of the second main flow channel. Preferably, the pump housing comprises a first pump housing member and a second pump housing member. The first inlet channel, the first main flow channel and the first outlet channel may be defined in series in the first pump housing member. The second inlet channel, the second main flow channel and the second outlet channel may be defined in series in the second pump housing. The first and second outlet channels may converge at a discharge port that is defined in the pump housing and opposes to an outer periphery of the impeller in the radial direction.

Because the fluid may be supplied into the first and second pump chambers via the first and second inlet channels, respectively, it is not necessary to provide communication holes in the impeller in order to communicate the fluid between the first and second pump chambers. Therefore, the fluid may be pumped by the pumping actions of the impeller as soon as the fluid reaches the start end of the first and second pump chambers via the first and second inlet channels. As a result, the pumping efficiency may be improved.

In another embodiment of the present teachings, at least one of the first inlet channel and the second inlet channel has a longitudinal axis that is offset in the axial direction of the impeller from a central axis of the corresponding pump chamber(s), and the central axes of the first pump chamber and the second pump chamber extend in the circumferential direction of the impeller.

Therefore, swirls of flow of the fluid may be effectively produced when the fluid enters from the at lest one of the first and second inlet channels into the corresponding pump chamber(s). As a result, the pumping efficiency can further improved.

According to another embodiment of the present teachings, at least one of the first and second inlet channels is inclined relative to a plane that is perpendicular to the axial direction of the impeller Therefore, the swirls of flow of the fluid can be intensified and the pumping efficiency can be further improved.

According to another embodiment of the present teachings, the first and second inlet channels open to the outside via respective inlet openings, and the first and second outlet channels communicate with the terminal ends of the first and second main flow channels via respective communication openings. At least one of the inlet openings extends along an angular range ($\alpha$) about a rotational axis of the impeller and the corresponding communication opening (s) extends along an angular range ($\beta$) about the rotational axis of the impeller. The angular range ($\alpha$) and the angular range ($\beta$) at least partly overlap with each other. Therefore, the inlet opening(s) may be positioned away from the start end(s) of the corresponding main flow channel toward the communication openings. As a result, the length of the at least one of the first and second inlet channels becomes longer to further improve the pumping efficiency.

According to another embodiment of the present teachings, each of the first and second main flow channels extend along a substantially arc shaped path, and at least one of the first and second inlet channels extends along a tangential direction with respect to the substantially arc shaped path of the corresponding main flow channel(s). Therefore, the fluid may smoothly enter the corresponding pump chamber(s) from the at least one of the first and second inlet channels without turbulence. As a result, the resistance against flow of the fluid may be reduced or minimized and the pumping efficiency may be improved.

According to another embodiment of the present teachings, at least one of the first and second inlet channels extends along a direction that is inclined outwardly by an angle of ($\theta$) relative to a tangential line (L1) with respect to the substantially arc shaped path of the corresponding main flow channel(s). Therefore, the length of the corresponding main flow channel(s) may become longer to further improve the pumping efficiency.

Preferably, the angle of ($\theta$) is defined by the tangential line (L1) and a central line (L2) of the at least one of the first and second inlet channels. The central line (L2) extends along a direction of a resultant vector (S1) from a first vector component (S2) and a second vector component (S3) of the flow velocity of the fluid at the start end of the corresponding main flow channel(s). The first vector component (S2) is oriented to extend along the tangential line (L1) and the second vector component (S3) is oriented in the radial direction of the impeller. With this arrangement, the swirls that may be produced at the start end(s) of the first main flow channel and/or the second main flow channel can be intensified to improve the pumping efficiency.

According to another embodiment of the present teachings, at least one of the first and second outlet channels extends along a direction that is inclined outwardly by an angle of (γ) relative to a tangential line (L3) with respect to the substantially arc shaped path of the corresponding main flow channel(s). Therefore, the length of the corresponding main flow channel(s) becomes longer to further improve the pumping efficiency.

Preferably, the angle of (γ) is defined by the tangential line (L3) and a central line (L4) of the at least one of the first and second outlet channels. The central line (L4) extends along a direction of a resultant vector (V1) from a first vector component (V2) and a second vector component (V3) of the flow velocity of the fluid at the terminal end(s) of corresponding main flow channel(s). The first vector component (V2) is oriented to extend along the tangential line (L3) and the second vector component (V3) is oriented in the radial direction of the impeller. With this arrangement, the fluid may smoothly flow out of the pump housing with minimum turbulence, so that the pumping efficiency can be further improved.

In another embodiment of the present teachings, the impeller pumps further include a motor, e.g., an electric motor, for rotating the impeller. Therefore, the impeller pumps can be advantageously used as fuel pumps that are disposed within fuel tanks of automobiles.

Each of the additional features and teachings disclosed above and below may be utilized separately or in conjunction with other features and teachings to provide improved impeller pumps and methods of using such impeller pumps. Representative examples of the present invention, which examples utilize many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Various representative embodiments will now be described with reference to FIGS. 1 to 7. Representative impeller pumps of these representative embodiments may be configured as generative or friction pumps and may be used as fuel pumps that are disposed within fuel tanks of vehicles, e.g., automobiles.

(First Representative Embodiment)

Figure 2:
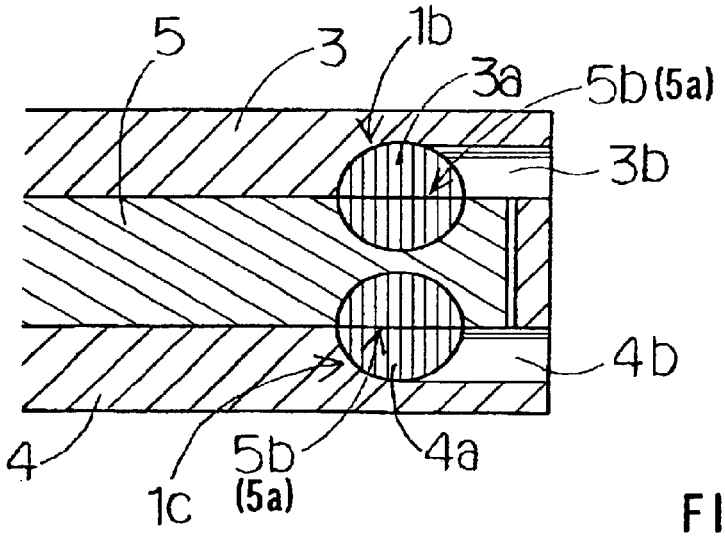
FIG. 2 is an enlarged vertical sectional view of a part of a pump housing of the first representative impeller pump.

Referring to FIGS. 1 and 2, a first representative impeller pump 1 is shown in a vertical sectional view and an enlarged view of a part of FIG. 1, respectively. The first representative impeller pump 1 may includes a main casing 2. A first pump housing member 3 and a second pump housing member 4 are disposed within the main casing 2 and may be coupled together to form a pump housing. A recess 3*e* is defined in the first pump housing member 3 and opposes to the second pump housing member 4. An impeller 5 is rotatably disposed within the recess 3*e*. An electric motor 6 is disposed within the main casing 2 and has an output shaft 6*a*. The output shaft 6*a* extends through the first pump housing member 3 and is coupled to the impeller 5, so that the impeller 5 rotates as the motor 5 is driven. A plurality of grooves 5*a* are defined in each of upper and lower surfaces of the impeller 5 and are spaced equally from each other in the circumferential direction of the impeller 5 so as to form a circumferential groove row 5*b*. Each of the grooves 5*a* has a substantially semicircular cross section and has a closed circumferential edge that defines an opening. Two adjacent grooves 5*a* of each groove row 5*b* may form a fin between each other.

A first main flow channel 3*a* and a second main flow channel 4*a* are defined as recesses formed in the first pump housing member 3 and the second pump housing member 4 and are disposed to oppose to the impeller 5 from the upper side and the lower side, respectively. Each of the first and second main flow channels 3*a* and 4*a* has a substantially arc shaped configuration. Inlet channels 3*b* and 4*b* also are defined as recesses formed in the first pump housing member 3 and the second pump housing member 4, respectively. The inlet channel 3*b* communicates with a start end in the circumferential direction of the first main flow channel 3*a* and extends substantially radially outward from the first main flow channel 3*a*. The inlet channel 4*b* communicates with a start end in the circumferential direction of the second main flow channel 4*a* and extends substantially radially outward from the first main flow channel 4*a*. Here, the inlet channels 3*b* and 4*b* are defined independently of each other and do not communicate with each other. A terminal end of the first main flow channel 3*a* opposite to the start end thereof and a terminal end of the second main flow channel 4*a* opposite to the start end thereof communicate with outlet channels 3*c* and 4*c*, respectively. The outlet channels 3*c* and 4*c* also are defined as recesses formed in the first pump housing member 3 and the second pump housing member 4, respectively. The outlet channels 3*c* and 4*c* extend outward in the radial direction of the impeller 5 and converge at a discharge port 3*d*. The discharge port 3*d* is defined in the first pump housing member 3 and is disposed to directly oppose to the outer periphery of the impeller 5 in the radial direction of the impeller 5. The discharge port 3*d* communicates with an inner space 1*a* defined within the main casing 2. An upper cover 7 is fixedly fitted into the upper portion of the main casing 2 and has an outlet port 7*a*. Therefore, the fuel discharged from the discharge port 3*d* may flow through the inner space 1*a* around the motor 6 and may then flow out of the impeller pump 1 via the outlet port 7*a*. The upper cover 7 rotatably supports one end of the output shaft 6*a* of the motor 6. The other end of the output shaft 6*a* is rotatably supported by the first pump housing member 3.

Figure 10:
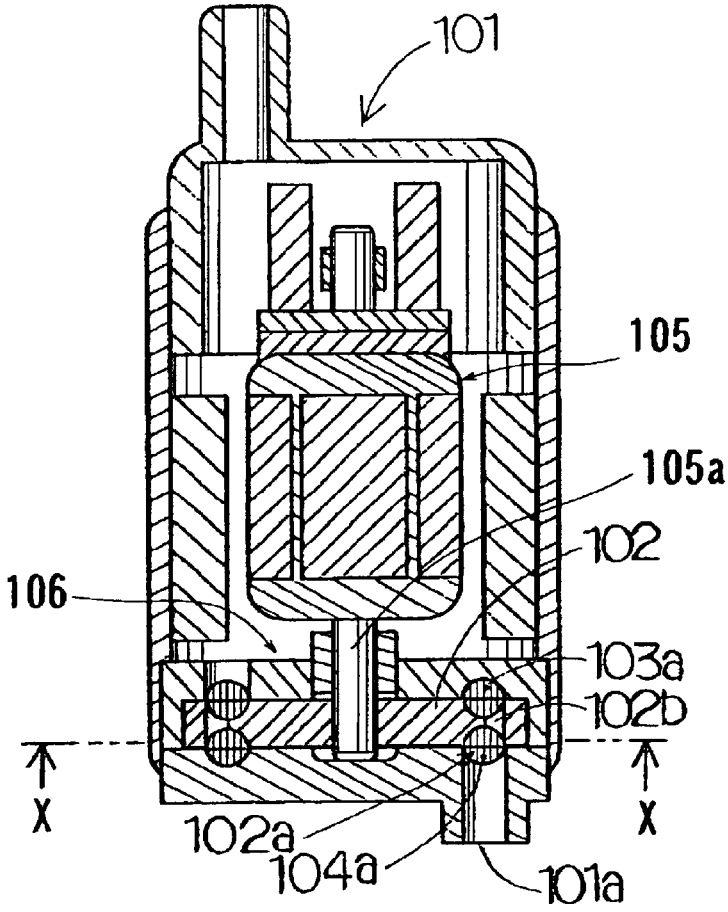
PRIOR ART FIG. 10 (a)
FIG. 10(*a*) is a vertical sectional view of a known impeller pump.
Figure 10:
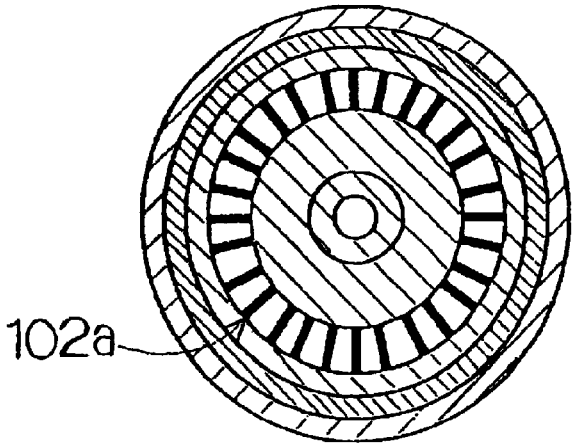
PRIOR ART FIG. 10 (b)

The operation of the above first representative impeller pump 1 will now be described. As the motor 6 is driven, the impeller 5 coupled to the output shaft 6*a* of the motor 6 rotates. Then, the rows 5*b* of the grooves 5*a* defined in both upper and lower surfaces of the impeller 5*a* may cooperate with the first and second main flow channels 3*a* and 4*b* to perform pumping operations based on a known principle of generative or friction pumping action, so that the fuel may be drawn from the outside of the impeller pump 1 into the first and second main flow channels 3*a* and 4*a* via the inlet channels 3*b* and 4*b*, respectively. In this way, the first main flow channel 3*a* and the second main flow channel 4*a* may cooperate with the respective rows 5*b* of the grooves 5*a* to define a first pump chamber 1*b* and a second pump chamber 1*c*, respectively. The fuel drawn into the first and the second pump chambers 1*b* and 1*c* may flow along the circumferential lengths of the first and second main chambers 1*b* and 1*c*. The fuel may then flow into the discharge port 3*d* via the outlet channels 3*c* and 4*c* and may be discharged to the outside of the impeller pump 1 via the inner space 1*a* around the motor 6 and the outlet port 7*a*. The impeller 5 of the impeller pump 1 is different from the impeller of the known impeller pump (see FIG. 10), because the impeller 5 does not have any communication holes that communicate between two recesses 5*a* that oppose to each other in the axial direction of the impeller 5. Therefore, the swirl of flow of the fuel may be produced within the recesses 5*a* even at positions adjacent to the terminal ends of the inlet channels 3*b* and 4*b* (at the start ends of the first and second main flow channels 3*a* and 4*a*) in order to provide the pumping actions.

Second to eighth representative embodiments will now be described with reference to FIGS. 3 to 9. These representative embodiments are modifications of the first representative embodiment. Therefore, in FIGS. 3 to 9, like members are given the same reference numerals as the first representative embodiment and explanation of these elements will not be necessary.

(Second Representative Embodiment)

Figure 3:
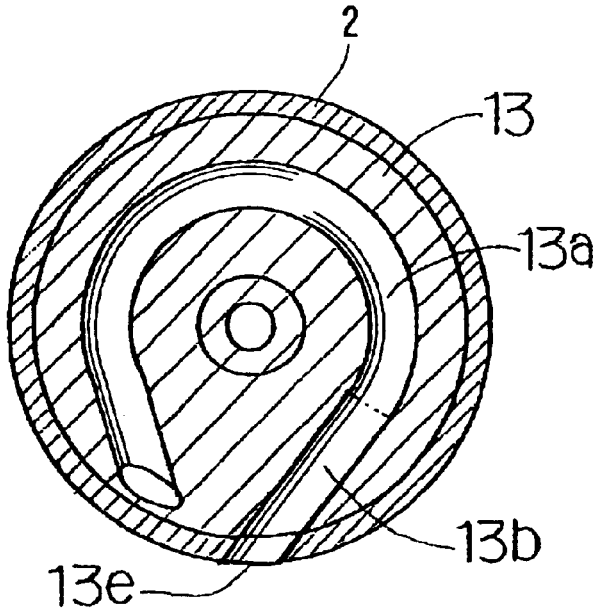
FIG. 3 is a cross sectional view of a pump housing of a second representative impeller pump.

Referring to FIG. 3, there is shown a cross sectional view of a second representative impeller pump, which is different from the first representative impeller pump 1 only in the configuration of a first pump housing member 13 that corresponds to the first pump housing member 3 of the first representative impeller pump 1. As shown in FIG. 3, a first main flow channel 13*a* and an inlet channel 13*b* are defined in the first pump housing member 13. The inlet channel 13*b* communicates with the first main flow channel 13*a* and extends substantially tangentially from the start end of the first main flow channel 13*a* that is configured to have a substantially arc-shaped configuration similar to the first main flow channel 3*a* of the first representative embodiment. The inlet channel 13*b* opens to the outside via an inlet opening 13*e*.

Because the inlet channel 13*b* is arranged to extend substantially tangentially from the first main flow channel 13*a*, the fuel that enters the inlet channel 13*b* via the inlet opening 13*e* flows into the first main flow channel 13*a* without producing any turbulence. Therefore, resistance against the flow of the fluid that is drawn into the first main flow channel 13*a* may be reduced or minimized. As a result, the pumping efficiency may be further improved.

Although not shown in the drawings, an inlet channel communicating with a second main flow channel also may be configured to extend substantially tangentially from the start end of the second main flow channel.

(Third Representative Embodiment)

Figure 4:
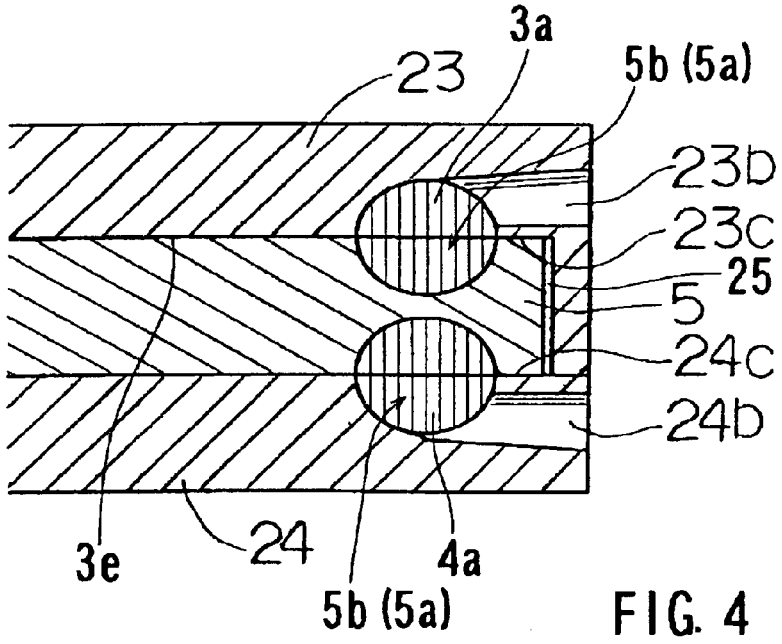
FIG. 4 is an enlarged vertical sectional view similar to FIG. 2 but showing a part of a pump housing of a third representative impeller pump.

Referring to FIG. 4, there is shown an enlarged sectional view of a pump housing of a third representative impeller pump. FIG. 4 corresponds to FIG. 2 of the first representative embodiment. The third representative impeller pump is different from the first representative impeller pump 1 only in the configurations of a first pump housing member 23 and a second pump housing member 24 that correspond to the first pump housing member 3 and the second pump housing member 4 of the first representative impeller pump 1, respectively. As shown in FIG. 4, the first and second pump housing members 23 and 24 have inlet channels 23*b* and 24*c* that are configured as bores that extend substantially in a horizontal direction, i.e., within a plane that is perpendicular to the rotational axis of the impeller 5, respectively. Thus, the inlet channels 23*b* and 24*c* do not directly open into the recess 3*e* that is defined in the first pump housing member 23 for receiving the impeller 5. Therefore, a minimum clearance 23*c* can be ensured between the first pump housing members 23 and the upper surface of the impeller 5 in a position adjacent to the inlet channel 23*b*. Similarly, a minimum clearance 24*c* can be ensured between the second pump housing member 24 and the lower surface of the impeller 5 in a position adjacent to the inlet channel 24*b*.

Due to the minimum clearances 23*c* and 24*c*, the fuel drawn into the inlet channels 23*b* and 24*b* may be prevented from causing leakage to a radial space 25 that is defined between the outer circumferential surface of the impeller 5 and a wall of the recess 3*e* opposing to the impeller 5 in the radial direction. Therefore, the pumping efficiency may be further improved. The inlet channels 23*b* and 24*b* may have various cross sectional configurations, e.g., circular configurations, elliptical configurations and rectangular configurations as will be hereinafter described in connection with fourth and fifth representative embodiments. The fourth and fifth representative embodiments relate to specific cross sectional configurations and the arrangement of the inlet channels, respectively. In other respect, the fourth and fifth representative embodiments are the same as the third representative embodiment.

(Fourth Representative Embodiment)

Figure 5:
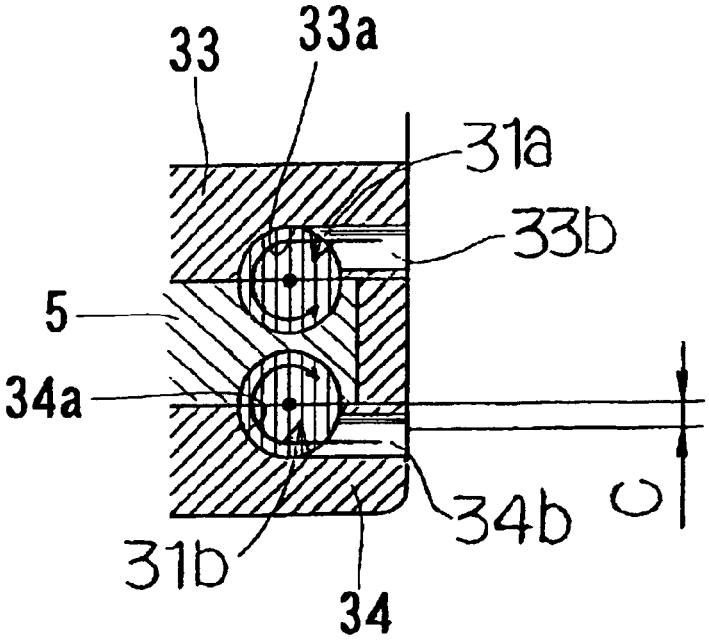
FIG. 5(*a*) is an enlarged vertical sectional view of a part of a pump housing of a fourth representative impeller pump.
Figure 5:
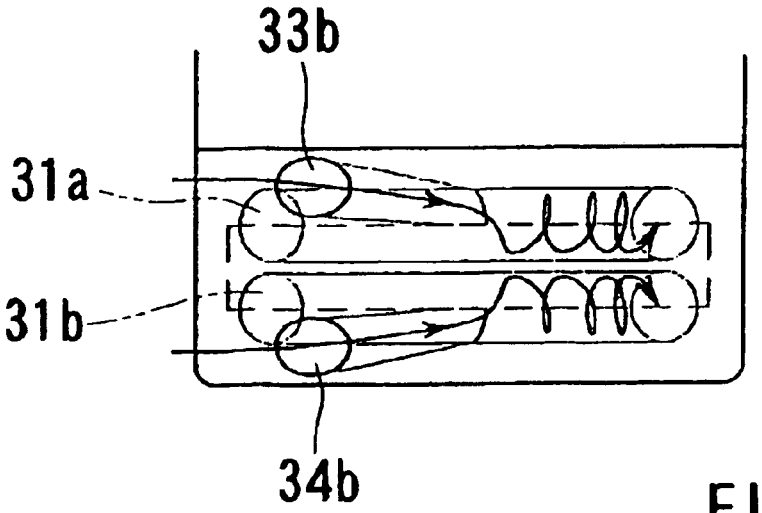

Referring to FIG. 5(*a*), there is shown an enlarged sectional view of a pump housing of the fourth representative impeller pump. The fourth representative impeller pump includes a first pump housing member 33 and a second housing member 34 that corresponds to the first pump housing member 23 and the second pump housing member 24 of the third representative embodiment, respectively. An inlet channel 33*b* is defined in the first pump housing member 33 and an inlet channel 34*b* is defined in the second pump housing member 34. Each of the inlet channels 33*b* and 34*b* has a substantially circular cross section and has a central axis that is offset from the central axis of a corresponding first pump chamber 31*a* or second pump chamber 31*b* by a distance C. The fist and second pump chambers 31*a* and 31*b* are defined between a first pump channel 33*a* formed in the first pump housing member 33 and the grooves 5*a* on the upper side of the impeller 5 and between a second pomp channel 34*a* formed in the second pump housing member 34 and the grooves 5*a* on the lower side of the impeller 5. In the representative embodiment shown in FIG. 5(*a*), each of the first and second pump channels 33*a* and the grooves 5*a* has a substantially semi-circular configuration. Therefore, the central axes of the first and second pump chambers 31*a* and 31*b* are positioned substantially within boundary planes between the first and second pump housing members 33 and 34 and the impeller 5.

Because the central axes of the inlet channels 33*a* and 33*b* are offset from the central axes of the respective fist and second pump chambers 31*a* and 31*b* by the distance C, the flow of the fuel that enters from the inlet channels 33*a* and 33*b* into the first and second pump chambers 31*a* and 31*b*, respectively, may reliably produce swirls as indicated by arrows in FIG. 5(*a*). As a result, the pumping efficiency can be further improved.

Although the inlet channels 33*a* and 33*b* extend in the horizontal direction, i.e., parallel to planes within which the central axes of the first and second pump chambers 31*a* and 31*b* extend, respectively, in the third representative impeller pump shown in FIG. 5(*a*), the inlet channels 33*b* and 34*b* may be inclined relative to the respective planes of the central axes of the first and second pump chambers 31*a* and 31*b* as shown in FIG. 5(*b*). With this arrangement, the flow of the fuel that enters from the inlet channels 33*a* and 33*b* into the first and second pump chambers 31*a* and 31*b*, respectively, may further reliably produce swils as indicated by arrows in FIG. 5(*b*). As a result, the pumping efficiency may be further improved.

(Fifth Representative Embodiment)

Figure 6:
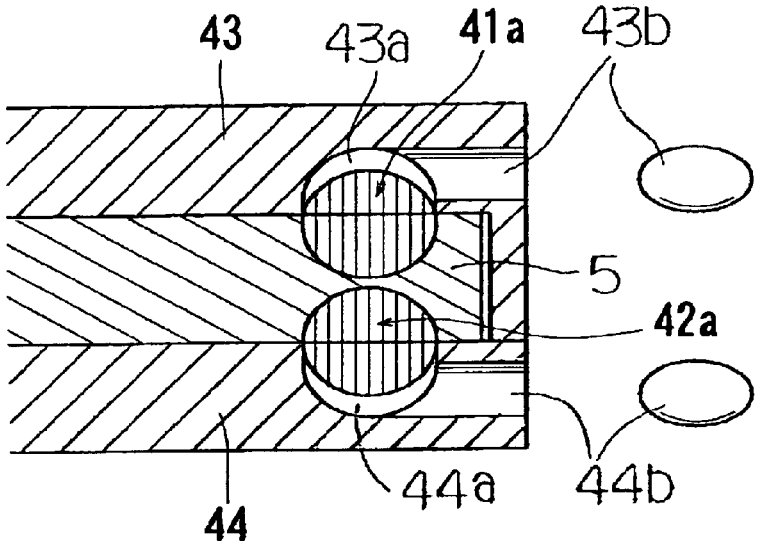
FIG. 6(*a*) is an enlarged vertical sectional view similar to FIG. 4 but showing a part of a pump housing of a fifth representative impeller pump.
Figure 6:
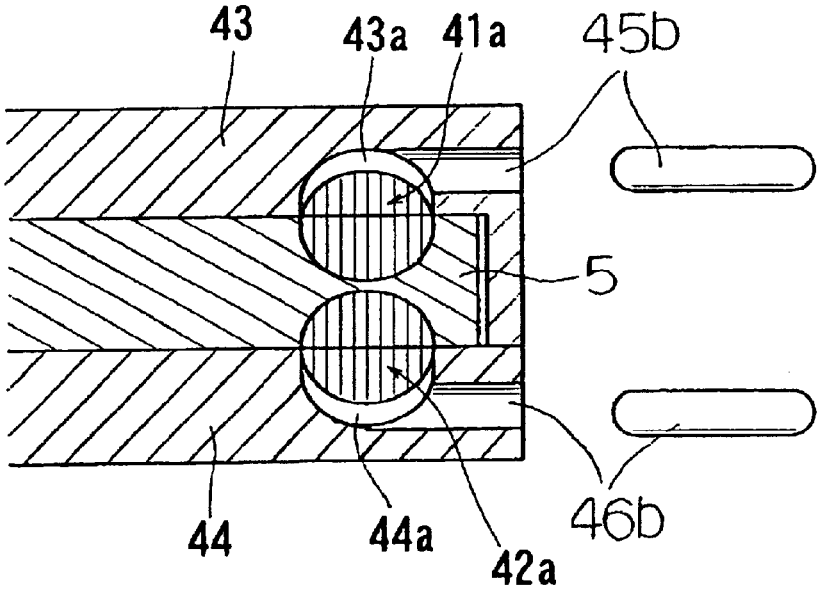

Referring to FIG. 6(*a*), there is shown an enlarged sectional view of a part of a pump housing of the fifth representative impeller pump. The fifth representative impeller pump includes a first pump housing member 43 and a second housing member 44 that correspond to the first pump housing member 23 and the second pump housing member 24 of the third representative embodiment, respectively. Each of an inlet channel 43*b* defined in the fit pump housing member 43 and an inlet channel 44*b* defined in the second pump housing member 44 has a substantially elliptical cross section that has a major axis extending in the horizontal direction. Also in this representative embodiment, each of the inlet channels 43*b* and 44*b* has a central axis that is offset from the central axis of a corresponding first pump channel 41*a* or second pump channel 42*a* by a predetermined distance. Here, the first pump channel 41*a* is defined by the recesses 5*a* on the upper side of the impeller 5 and a first main flow channel 43*a* formed in the first housing member 43. The second pump channel 42*a* is defined by the recesses 5*a* on the lower side of the impeller 5 and a second main channel 44*a* formed in the second pump housing member 44.

In the fifth representative impeller pumps, the cross sectional configurations of the inlet channels 43*b* and 44*b* are elongated or flattened (in comparison with the circular cross sectional configuration) in the horizontal direction or the directions parallel to planes within which central axes of the first and second pump chambers 41*a* and 42*a* extend. Therefore, the offset distance of the inlet channels 43*b* and 44*b* from the central axes of the respective first and second pump chambers 41*a* and 42*a* can be increased and the swirls can be produced for a broader range in the horizontal direction. As a result, the swirls of the flow of the fuel may be intensified and such intensified swirls may be produced at the start ends of the first and second pump channels 43*a* and 44*b* (or the first and second pump chambers 41*a* and 42*a*) immediately after the fuel flows into these pump channels. Therefore, the pumping efficiency may be further improved. In addition, transmission of pulsations of flow of the fuel (that may be produced as the impeller 5 rotates for performing the pumping actions) to the outside via the inlet channels may be reduced or minimized, so that pump noises may be reduced or minimized.

Referring to FIG. 6(*b*), there is shown an enlarged sectional view of a pump housing of a modification of the fifth representative impeller pump. Each of an inlet channel 45*b* defined in the first pump housing member 43 and an inlet channel 46*b* defined in the second pump housing member 44 has a substantially rectangular cross sectional configuration that has long sides extending in the horizontal direction. The short sides of the inlet channels 45*b* and 46*b* are rounded. Also in this representative embodiment, each of the inlet channels 45*a* and 46*b* has a central axis that is offset from the central axis of the corresponding first pump chamber 41*a* and the second pump chamber 42*a* by a predetermined distance.

Also in this modification, the cross sectional configurations of the inlet channels 45*b* and 46*b* are elongated or flattened in the horizontal direction or the directions parallel to planes of the central axes of the first and second pump chambers 41*a* and 42*a*. Therefore, the same operations and advantages as the fifth representative embodiment can be attained.

In addition, also in the above fifth representative embodiment and its modification, the inlet channels 43*b* and 44*b* (inlet channels 45*b* and 46*b*) may be inclined relative to the horizontal direction, i.e., planes within which the central axes of the first and second pump channels extend as explained in connection with the modification of the fourth representative embodiment shown in FIG. 5(*b*).

(Sixth Representative Embodiment)

Figure 7:
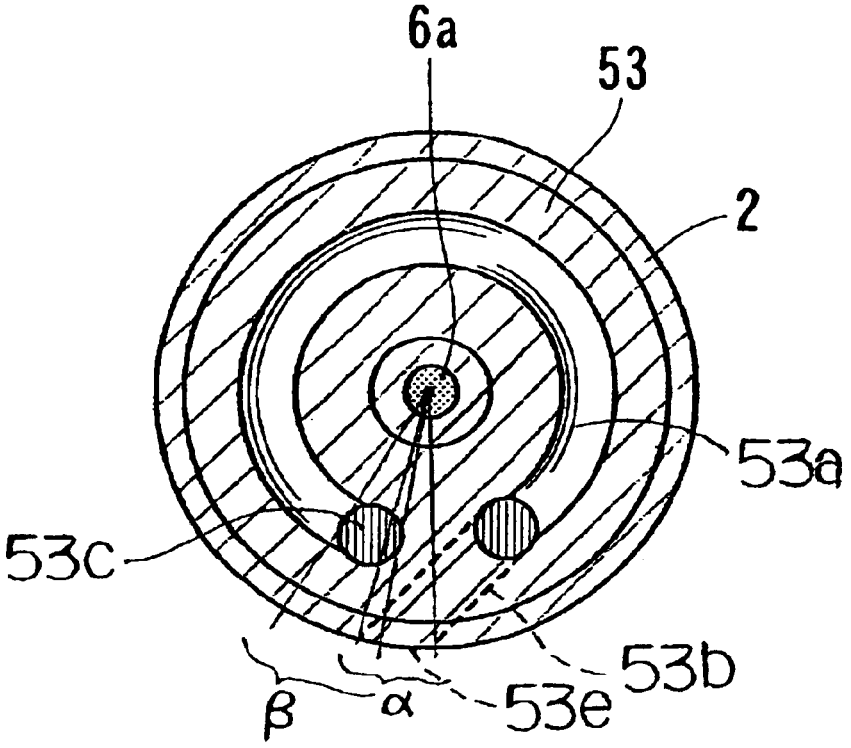
FIG. 7(*a*) is a cross sectional view of a pump housing of a sixth representative impeller pump.
Figure 7:
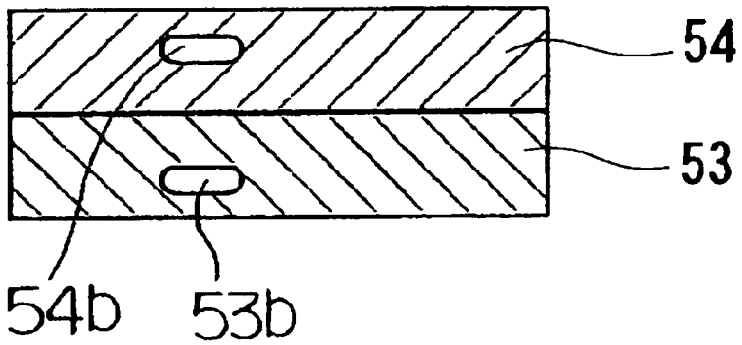

A sixth representative embodiment will now be described with reference to FIGS. 7(*a*) and 7(*b*). Referring to FIG. 7(*a*), there is shown a cross sectional view of a pump housing of a sixth representative impeller pump. The sixth representative impeller pump also is a modification of the third representative impeller pump and is different from the third representative impeller pump only in the configurations of inlet channels.

The sixth representative impeller pump includes a first pump housing member 54 and a second housing member 53 that corresponds to the first pump housing member 23 and the second pump housing member 24 of the third representative embodiment, respectively. Each of an inlet channel 54*b* defined in the first pump housing member 54 and an inlet channel 53*b* defined in the second pump housing member 53 has a substantially rectangular cross section elongated in the horizontal direction and has a central axis that is offset from the central axis of a corresponding pump channel by a predetermined distance.

As shown in FIG. 7(*a*), one end of the inlet channel 53*b* communicates with a start end of a second main flow channel 53*a* and the other end of the inlet channel 53*b* opens to the outside via an inlet opening 53*e* formed in the main casing 2. The inlet opening 53*e* has width that extends by a range of an angle a about the drive shaft 6*a* of the motor 6, i.e., the rotational axis of the impeller 5. On the other hand, an outlet channel 53*c* communicates with a terminal end of the second main flow channel 53*a* via a substantially circular opening as viewed in FIG. 7(*a*), which opening has a width that extends by a range of an angle $\beta$ about the drive shaft 6*a* of the motor 6. As shown in FIG. 7(*a*), the range of the angle $\alpha$ is set to overlap with the range of the angle $\beta$.

With this arrangement, the flow path constituted by the inlet channel 53*b* and the second main flow channel 53*a* may have a length that is greater than the same flow path according to the design, in which the range of the angle $\alpha$ is set not to overlap with the range of the angle $\beta$. Thus, the length of the inlet channel 53*b* may become longer as the position of the inlet opening 53*e* is set to be farther away from the start end of the second main flow channel 53*a* in the clockwise direction as viewed in FIG. 7(*a*).

Because the flow path constituted by the inlet channel 53*b* may have a greater length, the pumping efficiency can be further improved.

Although not shown in the drawings, an angular range of an inlet opening of the inlet channel 54*b* also is set to overlap with an angular range of an opening of an outlet channel at a terminal end of a first pump channel.

(Seventh Representative Embodiment)

Figure 8:
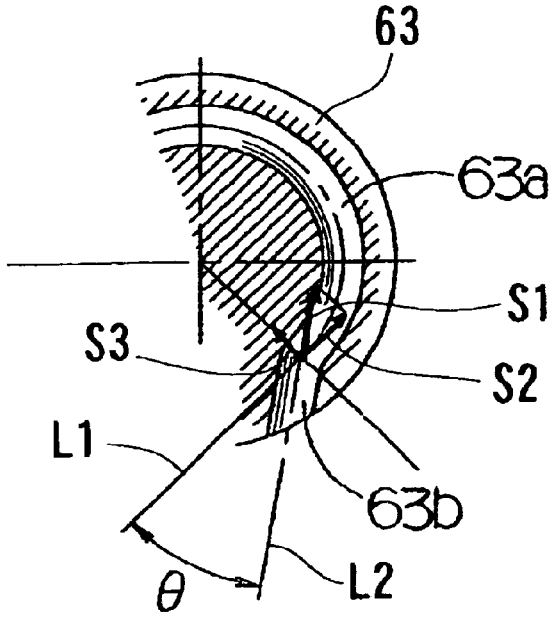
FIG. 8 is a cross sectional view, with a part omitted, of a pump housing of a seventh representative impeller pump.

A seventh representative embodiment will now be described with reference to FIG. 8. Referring to FIG. 8, there is shown a cross sectional view of a part of a pump housing of a seventh representative impeller pump. The seventh representative impeller pump also is a modification of the third representative impeller pump and is different from the third representative impeller pump only in the configurations of inlet channels.

Referring to FIG. 8, a second main flow channel 63*a* and an inlet channel 63*b* are defined in a second pump housing member 63. The second main flow channel 63*a*, the inlet channel 63*b* and the second pump housing member 63 correspond to the second main flow channel 4*a*, the inlet channel 24*b* and the second pump housing member 24 of the third representative impeller pump, respectively (see FIG. 4).

As shown in FIG. 8, the inlet channel 63*b* is inclined outward of the second pump housing member 24 by an angle θ (0°<θ<90°) relative to a tangential line L1 that is drawn from an arc that defines the central line extending along the circumferential direction of the second main flow channel 63*a*.

With this arrangement, the start end of the second main flow channel 63*a* can be positioned on the side in the clockwise direction than the position in the arrangement where the inlet channel extends in the radial direction of the impeller. Therefore, the second main flow channel 63*a* may have a longer length, so that the pumping efficiency can be improved. Preferably, a line L2 that defines the angle θ and corresponds to the central line of the inlet channel 63*b* extends along a direction of arrow S1 shown in FIG. 8. Here, the arrow S1 indicates a resultant vector from a main vector component S2 and a swirl vector component S3 of the flow velocity of the fuel at the start end of the main flow channel 63*a*. The main vector component S2 is oriented toward the tangential direction and the swirl vector component S3 is oriented in the radial direction. With this arrangement, the intensity of swirls may be further increased, so that the pumping efficiency may be further improved.

Although not shown in FIG. 8*a*, an inlet channel communicating with a first main flow channel also may be configured in the same manner as the inlet channel 63*b* of the second pump housing member 53 described above.

(Eighth Representative Embodiment)

Figure 9:
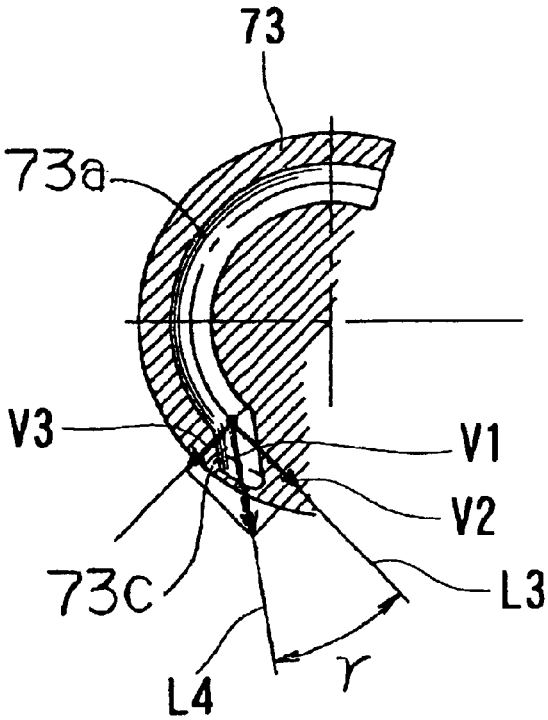
FIG. 9 is a cross sectional view, with a part omitted, of a pump housing of an eighth representative impeller pump.

An eighth representative embodiment will now be described with reference to FIG. 9. Referring to FIG. 9, there is shown a cross sectional view of a part of a pump housing of an eighth representative impeller pump. The eighth representative impeller pump is a modification of the first representative impeller pump and is different from the first representative impeller pump only in the configurations of outlet channels.

Referring to FIG. 9, a second main flow channel 73*a* and an outlet channel 73*c* are defined in a second pump housing member 73. The second main flow channel 73*a*, the outlet channel 73*c* and the second pump housing member 73 correspond to the second main flow channel 4*a*, the outlet channel 4*c* and the second pump housing member 4 of the first representative impeller pump, respectively.

As shown in FIG. 9, the outlet channel 73*c* is inclined outward of the second pump housing member 73 by an angle γ (0°>γ>90°) relative to a tangential line L3 that is drawn from an arc that defines the central line extending in the circumferential direction of the second main flow channel 73*a*.

With this arrangement, the terminal end of the second main flow channel 73*a* can be positioned in the counterclockwise direction than the position in the arrangement where the outlet channel extends in the radial direction of the impeller. Therefore, the second main flow channel 73*a* may have a longer length, so that the pumping efficiency can be improved. Preferably, a line L4 that defines the angle γ and corresponds to the central line of the inlet channel 63*b* extends along a direction of an arrow V1 shown in FIG. 9. Here, the arrow V1 indicates a resultant vector from a main vector component V2 and a swirl vector component V3 of the flow velocity of the fuel at the terminal end of the main flow channel 73*a*. The main vector component V2 is oriented toward the tangential direction and the swirl vector component V3 is oriented in the radial direction. With this arrangement, the fuel may flow out of the outlet channel 73*c* with reduced turbulence, so that the pumping efficiency can be further improved.

Although not shown in FIG. 9, an outlet channel communicating with a first main flow channel also may be configured in the same manner as the outlet channel 73*c* of the second pump housing member 73 described above. In addition, the arrangement of the outlet channel of this eighth representative impeller pump may be incorporated in combination with the arrangement of the inlet channels described in connection with the second to seventh representative embodiments.

What is claimed is:

1. An impeller pump for a fluid, comprising:

a rotary impeller;

a pump housing defining a first main flow channel and a second main flow channel, wherein the rotary impeller is disposed within a space defined in the pump housing and opposes to the first main flow channel and the second main flow channel, respectively, so that a first pump chamber and a second pump chamber are defined on both sides of the impeller;

a first inlet channel and a second inlet channel defined in the pump housing, wherein the first inlet channel communicates with one end of the first main flow channel and the second inlet channel communicates with one end of the second main flow channel, respectively; so that the fluid is drawn into the first pump chamber and the second pump chamber via the first inlet channel and the second inlet channel, respectively, and a first outlet channel and a second outlet channel defined in the pump housing, wherein the first outlet channel communicates with the other end of the first main flow channel and the second outlet channel communicates with the other end of the second main flow channel.

2. An impeller pump as in claim 1, wherein the first and second inlet channels do not directly open into the space defined in the pump housing for rotatably receiving the impeller.

3. An impeller pump as in claim 2, wherein the first and second inlet channels are configured as separate bores formed in the pump housing.

4. An impeller pump as in claims 3, wherein the first pump chamber and the second pump chamber has a central axis that extend in the circumferential direction of the impeller, and at least one of the first inlet channel and second inlet channels has a longitudinal axis that is offset in the axial direction of the impeller from the central axis of the corresponding first pump chamber and/or the second pump chamber.

5. An impeller pump as in claim 4, wherein the at least one of the first and second inlet channels is inclined relative to a plane that is perpendicular to the axial direction of the impeller.

6. An impeller pump as in claim 4, wherein the at least one of the first and second inlet channels has a cross sectional configuration that is elongated in a widthwise direction that is substantially perpendicular to the axial direction of the impeller.

7. An impeller pump as in claim 3, wherein the first and second inlet channels open to the outside via respective inlet openings, the first and second outlet channels communicate with the terminal ends of the first and second main flow channels via respective communication openings, the inlet opening of at least one of the first and second inlet channels extends along an angular range (α) about a rotational axis of the impeller, the communication opening of the corresponding first outlet channel and/or the second outlet channel extends along an angular range (β) about the rotational axis of the impeller, and the angular range (α) and the angular range (β) at least partly overlap with each other.

8. An impeller pump as in claim 1, wherein each of the first and second main flow channels extends along a substantially arc shaped path, and at least one of the first and second inlet channels extends along a tangential direction with respect to the substantially arc shaped path of the corresponding first main flow channel and/or second main flow channel.

9. An impeller pump as in claim 3, wherein each of the first and second main flow channels extends along a substantially arc shaped path, and at least one of the first and second inlet channels extends along a direction that is inclined outwardly by an angle of (θ) relative to a tangential line (L1) with respect to the substantially arc shaped path of the corresponding first main flow channel and/or second main flow channels.

10. An impeller pump as in claim 9, wherein the angle of (θ) is defined by the tangential line (L1) and a central line (L2) of the at least one of the first and second inlet channels, and the central line (L2) extends along a direction of a resultant vector (S1) from a first vector component (S2) and a second vector component (S3) of the flow velocity of the fluid at the start end of the corresponding first main flow channel and/or second main flow channel, and the first vector component (S2) is oriented to extend along the tangential line and the second vector component (S3) is oriented in the radial direction of the impeller.

11. An impeller pump as in claim 3, wherein each of the first and second main flow channels extends along a substantially arc shaped path, and at least one of the first and second outlet channels extends along a direction that is inclined outwardly by an angle of (γ) relative to tangential line L(3) with respect to the substantially arc shaped path of the corresponding first main flow channel and/or the second main flow channel.

12. An impeller pump as in claim 11, wherein the angle of (γ) is defined by the tangential line (L3) and a central line (L4) of each of the first and second outlet channels, and the central line (L4) extends along a direction of a resultant vector (V1) from a first vector component (V2) and a second vector component (v3) of the flow velocity of the fluid at the terminal end of the corresponding first main flow channel and/or second main flow channel, and the first vector component (V2) is oriented to extend along the tangential line and the second vector component (V3) is oriented in the radial direction of the impeller.

13. An impeller pump as in claim 1, further including a convergence port defined in the pump housing in a position opposing to an outer periphery of the impeller in a radial direction of the impeller, wherein the flow of the fluid from the first outlet channel and the flow of the fluid from the second outlet channel converge at the convergence port.

14. An impeller pump as in claim 1, wherein the pump housing comprises a first pump housing member and a second pump housing member, the first inlet channel, the first main flow channel and the first outlet channel are defined in series in the first pump housing member, and the second inlet channel, the second main flow channel and the second outlet channel are defined in series in the second pump housing.

15. An impeller pump as in claim 1, wherein the impeller comprises a row of grooves on either side of the impeller and has no communication holes that extend through the impeller in an axial direction in order to connect the first pump chamber and the second pump chamber.

16. An impeller pump as in claim 1, further comprising a motor arranged and constructed to rotate the impeller.

17. An impeller pump for a fluid, comprising:

a rotary impeller without communication holes extending in an axial direction of the impeller;

a pump housing arranged and constructed to rotatably receive the impeller, wherein the pump housing defines a first pump chamber and a second pump chamber on either side of the impeller;

inlet means for communicating between one end of each of the first and second pump chambers and the outside of the pump housing; and outlet means for communicating between the other end of each of the first and second pump chambers and the outside of the pump housing.

18. An impeller pump as in claim 17, wherein the inlet means comprises a first inlet channel and a second inlet channel that are defined separately in the pump housing, and the outlet means comprises a first outlet channel and a second outlet channel that are defined separately in the pump housing.

19. An impeller pump as in claim 18, wherein each of the first and second pump chambers has a substantially arc shaped configuration, at least on of the first and second inlet channels extends in a substantially tangential direction from the one end of the corresponding first pump chamber and/or second pump chamber or is inclined by an angle of (θ) ($0° < \theta < 90°$) relative to the tangential direction.

20. An impeller pump as in claim 18, wherein at least one of the first and second inlet channels has a central axis that is offset or is inclined relative to a plane within which the corresponding first pump chamber and/or second pump chamber.

* * * * *